United States Patent [19]

Cook et al.

[11] 4,179,979

[45] Dec. 25, 1979

[54] BALLISTIC ARMOR SYSTEM

[75] Inventors: Richard L. Cook, Phoenix, Ariz.; William J. Hampshire, Bellevue, Wash.; Robert V. Kolarik, North Canton, Ohio

[73] Assignee: Goodyear Aerospace Corporation, Akron, Ohio

[21] Appl. No.: 638,699

[22] Filed: May 10, 1967

[51] Int. Cl.[2] ..... F41H 5/16

[52] U.S. Cl. ..... 89/36 A; 109/49.5; 428/228; 428/241; 428/247; 428/325; 428/911

[58] Field of Search ..... 161/404, 168; 89/36 A; 109/49.5; 428/228, 241, 247, 325, 911

[56] References Cited

U.S. PATENT DOCUMENTS

| | | | |
|---|---|---|---|
| 2,733,177 | 1/1956 | Meyer | 89/36 A |
| 3,324,768 | 6/1967 | Eichelberger | 89/36 A |
| 3,351,374 | 11/1967 | Forsyth et al. | 89/36 A X |
| 3,431,818 | 3/1969 | King | 89/36 A |
| 3,523,057 | 8/1970 | Buck | 89/36 A X |

FOREIGN PATENT DOCUMENTS

| | | | |
|---|---|---|---|
| 1178328 | 9/1964 | Fed. Rep. of Germany | 89/36 A |

*Primary Examiner*—Richard D. Lovering
*Attorney, Agent, or Firm*—P. E. Milliken; E. W. Oldham; D. J. Hudak

[57] ABSTRACT

An armor system matrix is provided, having a multiple layer system of very hard geometric objects tensionally restrained in their layers by fiber material interwoven about the objects with the objects and fiber material being bonded together by an adhesive material. The objects are substantially spherical ceramic material which may be of different dimensions, each ceramic sphere being substantially in contact with adjacent spheres on the same and adjacent parallel layers. Larger ceramic spheres may be located in the layers closer to the exposed surface of the armor system. The tensional relationship of the ceramic objects in each layer effectively distributes the impact of projectiles over a greater surface area.

5 Claims, 7 Drawing Figures

BALLISTIC ARMOR SYSTEM

This invention relates to a novel ballistic armor system, and more specifically to the incorporation of a unique armor design utilizing small uniform geometrically shaped objects, being very hard and capable of great compression without fracture, arranged in oriented layers in combination with tensional support to achieve a lightweight very effective armor system, preferably without utilizing any metal.

Heretofore it has been well known that there have been many and various types of ballistic armor systems, with these systems being adaptable for military use in association with tanks, helicopters, ships and other military equipment which is desired to be protected from the penetration of armor piercing or other type ballistic missiles or projectiles. Conventionally these systems have consisted of very thick steel plate of the highest grade. However, with the advent of armor piercing type projectiles, and larger projectiles, the use of steel plate with its high weight characteristics has become almost prohibitive because of the great thickness now required to defeat these modern projectiles. Therefore, there have been attempts to create other type lighter weight ballistic armor systems which would defeat modern armor piercing projectiles without having such great weight or bulk so as to make them practical particularly for application to tanks and other moving surface vehicles. However, these prior art attempts have been generally ineffective particularly against the best armor piercing projectiles available today. Besides, they have been extremely difficult to incorporate into the present armor systems, and are very expensive.

Therefore, it is the general object of the present invention to avoid and overcome the foregoing and other difficulties of and objections to prior art practices by the provisions of a ballistic armor system which utilizes a plurality of very hard spherical shaped balls arranged in oriented layers and supported in tension in their respective layers to effectively break up and defeat armor piercing type projectiles with weight per square foot ratios much less than in corresponding steel armor plate.

A further object of the invention is to provide an improved ballistic armor system which does not incorporate any metal, but uses very hard geometrically shaped ceramic objects arranged in oriented layers to effectively deflect and break up an armor piercing projectile with pound per square foot requirements much less than needed by conventional steel armor plate or other armor systems.

A further object of the invention is to provide a ballistic armor system which more effectively distributes the impact force of a projectile over a much greater area of the armor by a chain reaction combination of a plurality of very hard geometrically shaped objects being in contact with each other and further being supported by a material of great tensile strength interlaced between and around the objects.

Still a further object of the invention is to provide a ballistic armor system being extremely effective against the best armor piercing projectiles in use today which weighs much less than conventional armor systems, and is relatively low in cost.

Still another object of the invention is to provide a ballistic armor system engineered to apply structurally complementary materials in a manner to make best use of their strength properties, and more particularly to utilize a hard compressively strong particles bearing one upon another in chain reaction type physical alignment and constrained by interlaced materials of high tensile strength with the particles, presenting a continuously curved and therefore oblique surface to any projectile path thereby tending to tip and fracture the projectile into deflected fragments and defeat the projectile with a much lighter weight per square foot ratio than has heretofore been known.

The aforesaid objects of the invention and other objects which will become apparent as the description proceeds are achieved by providing in an armor system matrix the combination of a plurality of very hard compressively strong substantially uniformly geometric shaped particles arranged in parallel layered patterns whereby each particle is substantially in contact with those adjacent thereto on all sides, a material of great tensile strength interlaced between and around adjacent particles to be in tension while supporting the particles in their aligned layered relation, and adhesive means to bond the particles and material of the matrix into a compact but not completely integral mass.

For a better understanding of the invention reference should be had to the accompanying drawings wherein.

Figure 1:
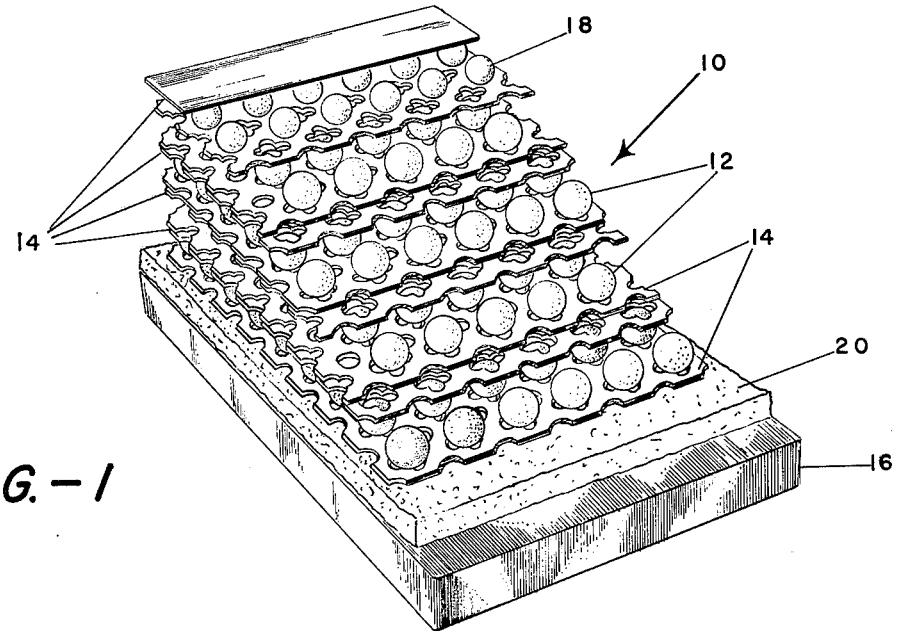
FIG. 1 is a perspective broken away illustration of oriented spheres arranged in layers and comprising a preferred embodiment of the invention.
Figure 2:
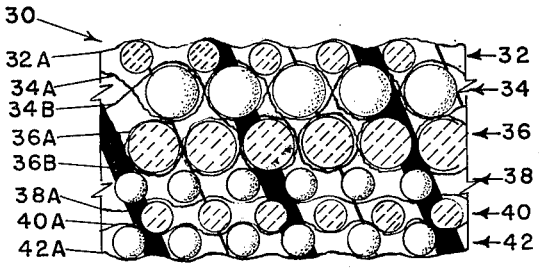
FIG. 2 is an enlarged cross sectional broken away view of another embodiment of an armor system matrix laminate utilizing the spherical shape particles illustrated in FIG. 1 and further showing the high tensile strength orienting members associated with the spheres.
Figure 3:
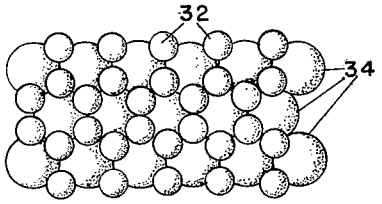
FIG. 3 is an enlarged plan view of a section of the matrix illustrated in FIGS. 1 and 2.
Figure 6:
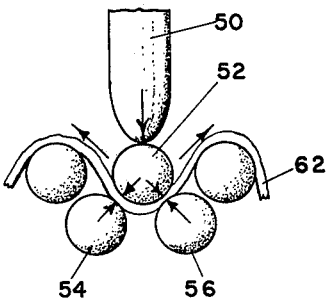
Figure 7:
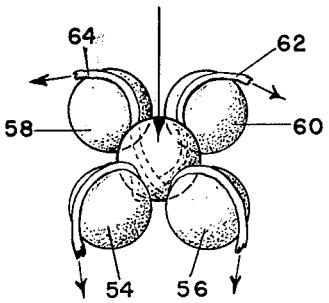

FIG. 6 is an enlarged schematic illustration of the force distribution caused when a projectile strikes the spherical arrangement illustrated in the embodiments of FIGS. 1 through 3 and showing how compressive forces and tensile forces greatly distribute the impact of the projectile throughout a much greater area of the armor; and FIG. 7 is an enlarged perspective view also illustrating the force distribution principles shown in FIG. 6 which achieve the desired objects of the invention.

The present invention is an improvement over a hard faced ceramic armor system illustrated and described in U.S. Pat. Application Ser. No. 268,765 filed on Mar. 28, 1963 and issued on May 5, 1970 as U.S. Pat. No. 3,509,833. It may be used separately from such armor system, or in combination therewith depending upon the situation, and hence it has been so illustrated and will be so described.

With reference to the form of the invention illustrated in FIG. 1 of the drawings, the numeral 10 indicates generally a ballistic armor system utilizing a plurality of alumina ceramic spheres, indicated generally by numeral 12, which are arranged in a plurality of oriented layers. More specifically, this embodiment, which is only representative, consists of five layers of spheres 12 each supported and oriented by separate aluminum sheets 14 having holes cut to properly orient the spheres. Preferably, the spheres will be ceramic with an alumina content of between about 85 to about 99 percent to provide an aggregate of extreme hardness that exhibits great resistance to fracture because of its very high compressive strength and basic geometry. The hardness of the spheres is directly proportional to the alumina content. The other matter in the spheres is generally glassy phases and fluxes which bind the remaining materials together. Normally, the spheres are isostatically molded under pressure to the desired shape and then kiln fired according to known techniques to complete the final cure. A solid aluminum base 16 provides a support for the entire matrix consisting of the spheres 12 and aluminum orienting sheets 14.

Preferably, in the example of FIG. 1, the first layer of spheres indicated by numeral 18 are about ½ the diameter of the remaining layers of spheres, with these spheres oriented so that the sphere patterns in alternating layers fall between the adjacent layers. In effect, this achieves an equilateral triangular relationship of the sphere patterns in adjacent layers in such a staggered manner so as to achieve a complete area coverage when viewing the laminate matrix from the top. This system 10 is then assembled into a single unit with a suitable polyurethane foam 20 preferably poured into the side between layers to fill all voids and essentially provide an integral composite matrix. The invention contemplates that a rigid polyurethane foam would be preferable, but polystyrene or other flexible foams might also be used. The foam, normally poured in the liquid state, then rises when activated under ambient conditions, or under increased temperature conditions to pass around the spheres and fill all voids. A rigid polyurethane foam such as that produced by reacting Plaskon Polyester Resin PFR-6 (Allied Chemical) and Glidfoam Prepolymer RCR-5043 (The Glidden Company) would be suitable to meet the objects of the invention.

In the embodiment illustrated in FIG. 1, the spheres 12 are in spaced relationship to each other and the only support between layers is provided by the thin aluminum sheets 14. Other suitable means to orientate the spheres might be used. For example, the spheres might be placed in long plastic tubes, with the tubes positioned in longitudinal alignment with each other. The spheres in adjacent layers are also in spaced relation to each other so when one is hit by the projectile, a small part of the momentum of the projectile is transferred to put the sphere in motion. This sphere then hits other spheres so a chain reaction type of energy transfer to other spheres tends to take place. In this embodiment of the invention then, a projectile striking substantially normal to the top surface or layer 18 will always meet an oblique surface and be deflected thereby so that together with the alternating positioned arrangement of the spheres 12 the projectile will be tilted and fractured thus transferring its energy over a wide area as the impact is absorbed by the matrix 10. In the embodiment of FIG. 1 there is very little support of the spheres 12 in their layers since the aluminum sheets 14 are mainly used for orientation prior to the final forming in matrix form with the polyurethane foam 20. Kinetic energy dissipation is achieved by the spaced relation of the spheres where each sphere absorbs some of the energy and is imparted a momentum of its own to be transferred by chain reaction with other spheres over a large area.

In actuality the sample illustrated in FIG. 1 utilized a first layer of ⅜ inch diameter spheres on 0.75 inch centers with the remaining four layers having ½ inch diameter spheres on 0.75 inch centers with every other layer shifted 0.375×0.375 inches from the first layer. For optimum results, the invention contemplates that the spacing between adjacent spheres be between about ⅓ to 1 times the diameter of the spheres. The entire structure of alumina ceramic spheres and aluminum was then formed in one operation with the polyurethane foam 20 serving to form a composite matrix as a retainer of the spheres, a stiffener for the aluminum sheets and an adhesive for bonding the face sheet and backing plate. The foam had a density of 15 lbs. per cubic foot. The areal density of this sample was 28.36 lbs. per sq. ft. of which only about 8.66 lbs per sq. ft. were contributed by the spheres. It was found that this sample would successfully stop a 14.5 mm armor piercing projectile at zero degree obliquity. This provides a 50% improvement factor in defeating the projectile over homogeneous steel armor. The tests were conducted with the projectile having a velocity of 3100 ft. per sec. and upon impact producing a kinetic energy of approximately 21,000 ft. lbs.

Another embodiment of the invention is illustrated in FIG. 2 which shows a six layered matrix, indicated generally by numeral 30 where a top layer 32 comprises smaller spheres and the next two layers 34 and 36 comprise large spheres of about twice the diameter as layer 32, and the bottom three layers 38, 40 and 42 again comprise smaller spheres. However, it should be noted in this embodiment of the invention that all of the spheres in each layer are substantially in contact with the adjacent spheres in their own layer as well as the spheres in the layers above or below thereto. Further, the spheres are supported in their respective layers by a formable fiber glass type material having high tensile strength and alternately molded or shaped around the spheres in each respective layer. A suitable material to provide this high tensile strength interweaving type layer is a material sold under the name "Spraypreg" by Goodyear Aerospace Corporation and recited in more detail in U.S. patent application Ser. No. 453,592, filed May 6, 1965 and issued on Apr. 16, 1968 as U.S. Pat. No. 3,378,613. In effect, this is a glass fiber and resin mix which has woven fabric-like properties and great tensile strength when properly cured under temperature and pressure.

The initial forming of the high tensile material into the matrix 30 may be easily accomplished in the layer formations shown in FIG. 2 with subsequent curing into an integrally bonded mass being easily achieved under suitable temperature and pressure. For example, the layers may be made up by hand or suitable machinery to include the spheres in proper orientation with the bonding formed in a mold under pressure allowing the high tensional material to flow into all the voids and completely surround the spheres. Such a molding technique is further described in the above-identified patent application. Hereinafter this high tensile strength material which is always formed in layers will be referred to as respective tension layers. Hence, a tension layer 32A intertwines and supports beneath the layer 32 of spheres while in a similar manner tension layers 34A and 34B respectively are interwoven around layer 34. In a similar manner, each of the other layers 36 through 42 has tension layers designated by suffix A and/or B associated therewith. It should also be noted that in the vertical cross section shown in FIG. 2 that only every other layer is indicated in section because of the stacked offset relation of the respective layers as illustrated and described above with reference to FIG. 1.

FIG. 3 further illustrates the relative offset spacing of the spheres in each layer relative to adjacent layers showing particularly how layer 32 is preferably arranged relative to layer 34 of FIG. 2. The smaller spheres in layer 32 are positioned into each of the gaps caused by the adjacent contacting of the larger spheres in layer 34. Thus, it can readily be seen with each layer so positioned it eliminates the possibility of any projectile no matter how small traveling through the matrix arrangement without contacting at least one sphere. The contacting of any sphere then transmits this contacting force to all spheres interconnected therewith in a stacked pyramid type chain-relation while also deflecting the projectile because of the curved or oblique surface of the spheres themselves. Naturally, the deflection of the projectile forces it into contact with other spheres thus further broadening the contacting base and distributing the impact force over a much larger area of the armor system.

FIGS. 6 and 7 best illustrate the two fold phenomenon represented by the spheres in combination with the respective tension layers to achieve the improved armor of the invention. Specifically, FIG. 6 illustrates a projectile 50 impacting upon a ceramic sphere 52 of very hard composition, and normally having an alumina content of between about 80 to about 99 percent alumina. The sphere 52 is in direct contact with at least four other spheres 54, 56, as seen in FIG. 6, and 58 and 60 as additionally seen in FIG. 7. The sphere 52 is further supported by the high strength tension layers 62 and 64 criss-crossing at least twice therebeneath. In reality, the invention contemplates that many tensile reinforcing strands will pass beneath each sphere, however only two are indicated for clarity in this figure of the drawings. Thus, the impacting force of the projectile 50 is met by the resistive compression forces of each of the spheres 52 through 60 as well as the tensional loading caused by the layers 62 and 64. The plurality of force arrows indicated in each of FIGS. 6 and 7 clearly illustrate this two fold force concept of the invention.

Thus, to simplify and summarize, the preferred embodiment of the invention includes an armor made of hard compressively strong particles, normally spheres, bearing one upon four others in courses or layers mechanically restrained or constrained by interlaced materials, such as Goodyear Aerospace's "Spraypreg", having high tensile strength. The spheres are geometrically restrained by the high strength tensile material interlaced through adjoining spaces between and alternating over and under adjacent spheres. In this manner, each sphere is supported instantaneously through a tension member by those around it in addition to those it bears compressively upon. The spherical shape is preferable because it is the strongest configuration for a particle and can be loaded only in compression. The continuously curved and therefore oblique surface almost invariably insures proper deflection of the projectile. The tipping of the projectile causes fracturing thereof into more deflecting fragments, and thus utilizes more of the armor to effectively defeat the projectile. One might reasonably compare the forced transfer in this situation as a cue ball hitting the head ball of a racked pack of fifteen billiard balls. Similar type of compressive loadings and pyramid type transfer of impact forces result.

Figure 4:
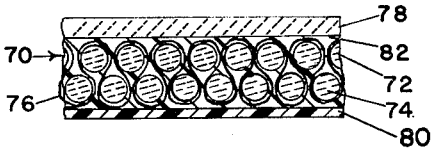
FIG. 4 is an enlarged broken away cross sectional view of a modified embodiment of the invention utilizing rod shaped particles instead of spherical shaped particles, but with the high tensile strength interlacing material associated therewith.
Figure 5:
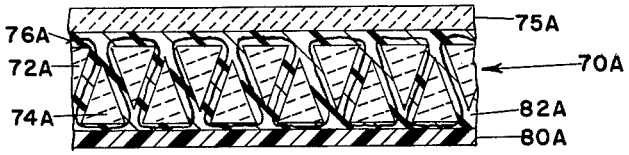
FIG. 5 is an enlarged broken away cross sectional view of yet another embodiment of the invention utilizing triangular shaped particles in a similar interlaced manner to that of FIG. 4.

FIGS. 4 and 5 illustrate modifications of the invention which also appear desirable in some instances. Specifically, FIG. 4 illustrates a plurality of cylindrically shaped rods, indicated generally by numeral 70 which are arranged in two layers 72 and 74 of alternating position and substantially in contact with a high tensile material 76 interwoven therearound so as to support each rod 70 in tension against impact, as explained above. A hard faced ceramic armor layer 78 and backing layer 80 are bonded in relation to the layers 72 and 74 by a suitable resin intermixture 82 such as that produced by reacting Plaskon Polyester Resin PRF-6 (Allied Chemical) and Glidfoam Prepolymer RCR-5043 (The Glidden Company) would form a suitable matrix in an integral mass.

Of course, again, the tensile material 76 supports the rods 70 in their aligned layers so that projectile defeating qualities are provided by the compressive force of the rods distributing impact along their length, and the tensional properties of the material 76, as described with the other embodiments above. A similar combination utilizing triangularly shaped elongated rod-like particles 70A are indicated in FIG. 5. Parts corresponding to those in FIG. 4 are indicated with suffix A.

Thus, it is seen that the invention comprises a composite armor system consisting of an arrangement of ceramic or other hard particles uniform in size, or in various orders of mass, shaped as spheres, cylinders or rods supported or held in place by material oriented in such a manner to react to impact loads in tension. This tension material is formed into the adjoining spaces between and alternating over and under adjacent particles in a manner to cause each particle to be supported by the particles surrounding it through the controlled vectorial translation of forces by the tension of such material.

It should be understood that the system is based upon the fact that in the prior art impact from high energy projectiles upon hard faced armor causes localized failure of the backing surface in shear or bearing before the load can be reacted in bending or tension as delamination occurs. Thus the invention utilizes the orientation of the supporting tensile material to improve its structural deficiency by loading it directly in tension at the instant impact occurs. This instant loading in tension is more clearly shown by FIGS. 6 and 7 of the drawings. In addition, the armor system is preferably made with the largest particles or spheres on the impact surface to insure fragmentization of the projectile. These upper layers are backed up by layers of smaller size particles or spheres arranged in pattern courses or layers to positively eliminate complete passage of any of the projectile fragments through the system.

It should be understood that this system may be designed to either completely defeat a projectile or only to break it up and pass small particles of low enough mass, and velocity and obliquity to be easily defeated by the normal vehicle shell or armor material. The armor material of the invention may also be fabricated in combination with a weldable metal backing plate to facilitate installation.

While in accordance with the Patent Statutes one best known embodiment of the invention has been illustrated and described in detail, it is to be particularly understood that the invention is not limited thereto or thereby, but that the inventive scope is defined in the appended claims.

What is claimed is:

1. In an armor system matrix, the combination of a plurality of very hard substantially uniformly geometric shaped objects arranged in parallel layered patterns whereby each object is substantially in contact with those adjacent thereon on all sides, said objects being spherically shaped with larger spheres adjacent to the normally outward and exposed surface, a material of great tensile strength interlaced between and around adjacent objects to be in tension while supporting the objects in their aligned relation, and an adhesive means to bond the objects and materials of the matrix into a solid and integral form.

2. In an armor system matrix the combination of a plurality of very hard spherical shaped ceramic balls of various sizes arranged in oriented layers with balls of uniform size in each layer, and the balls of adjacent layers arranged between each other in overlapped relation whereby all balls are substantially in contact with all adjacent balls in their layers and adjacent layers, a glass fiber and resin material of great tensile strength interlaced between and around adjacent balls in layers to be in tension while supporting the balls in their respective layers, and adhesive means to bond the balls and material of the matrix into a substantially solid and integral form.

3. A matrix according to claim 2 where each ball is in compressive support by at least four other balls.

4. A matrix according to claim 2 where the normally outward and exposed surface thereof is formed of balls of larger diameter than certain other layers of the matrix.

5. A matrix according to claim 2 where the objects in each respective layer are uniform in size, but the objects in at least certain of the layers are of varying size.

* * * * *